US009482034B2

(12) United States Patent
Atkinson, Jr.

(10) Patent No.: US 9,482,034 B2
(45) Date of Patent: Nov. 1, 2016

(54) SECURITY LATCH FOR DOOR HINGED TO OPEN OUTWARDLY

(71) Applicant: Joseph A Atkinson, Jr., Jefferson Hills, PA (US)

(72) Inventor: Joseph A Atkinson, Jr., Jefferson Hills, PA (US)

( * ) Notice: Subject to any disclaimer, the term of this patent is extended or adjusted under 35 U.S.C. 154(b) by 254 days.

(21) Appl. No.: 14/167,963

(22) Filed: Jan. 29, 2014

(65) Prior Publication Data

US 2014/0300114 A1 Oct. 9, 2014

Related U.S. Application Data

(60) Provisional application No. 61/808,544, filed on Apr. 4, 2013.

(51) Int. Cl.

| | |
|---|---|
| ***E05C 19/00*** | (2006.01) |
| ***E05B 63/18*** | (2006.01) |
| ***E05C 3/04*** | (2006.01) |
| ***E05C 17/44*** | (2006.01) |
| *E05B 63/00* | (2006.01) |

(52) U.S. Cl.

CPC ..... *E05B 63/18* (2013.01); *E05C 3/044* (2013.01); *E05C 17/44* (2013.01); *E05B 63/0008* (2013.01); *E05C 19/005* (2013.01); *Y10S 292/15* (2013.01); *Y10T 292/23* (2015.04)

(58) Field of Classification Search

CPC ..... E05C 3/044; E05C 17/44; E05C 19/005; Y10T 292/23; Y10S 292/15; E05B 63/18; E05B 17/0025; E05B 45/00; E05B 45/06; E05B 63/0008

USPC ..... 292/1, 288, 289, 297, DIG. 15, 259 R; 49/394

See application file for complete search history.

(56) References Cited

U.S. PATENT DOCUMENTS

| | | | | |
|---|---|---|---|---|
| 517,353 | A * | 3/1894 | Millard | E05B 65/0053 292/101 |
| 1,563,982 | A * | 12/1925 | Henderson | E05C 19/10 292/1 |
| 2,528,954 | A * | 11/1950 | Harbert | E05C 3/044 292/136 |
| 2,532,586 | A * | 12/1950 | Wickwire | E05C 19/18 292/288 |
| 3,661,413 | A | 5/1972 | Silva | |
| 4,094,541 | A | 6/1978 | Simms | |
| 4,679,835 | A * | 7/1987 | Weinerman | E05C 3/042 292/197 |
| 4,705,309 | A | 11/1987 | Sawchuk | |
| 4,955,648 | A * | 9/1990 | Miller | E05C 19/18 292/258 |
| 5,462,320 | A * | 10/1995 | Davis | E05B 17/10 29/434 |
| 5,490,304 | A | 2/1996 | Winner, Jr. | |
| 5,704,662 | A * | 1/1998 | Kwiatkowski | E05B 17/2023 292/194 |
| 6,330,771 | B1 * | 12/2001 | Hester, Jr. | E04H 3/08 52/106 |
| 6,361,088 | B1 * | 3/2002 | Ramsauer | E05B 9/08 292/202 |

(Continued)

FOREIGN PATENT DOCUMENTS

| | | | |
|---|---|---|---|
| DE | 1553456 | A1 * | 9/1970 |
| FR | 392135 | A * | 11/1908 |

(Continued)

*Primary Examiner* — Kristina Fulton
*Assistant Examiner* — Christine M Mills
(74) *Attorney, Agent, or Firm* — Gary P. Topolosky

(57) ABSTRACT

A security latch apparatus for the interior of a school or industrial door hinged to open outwardly. The latch includes a lower mounting door bracket with a pivotable handle designed to fit firmly against the interior doorframe and prevent that door from being prematurely pulled open. A disengagement rod is provided for authorized personnel to manually undo a secured door from its exterior.

20 Claims, 14 Drawing Sheets

(56) References Cited

U.S. PATENT DOCUMENTS 6,393,878 B1 * 5/2002 Fayngersh ..... E05B 59/00 292/169.14
6,487,751 B2 * 12/2002 Renaud ..... E05B 17/005 16/83
6,550,186 B2 4/2003 Haq
6,695,507 B1 * 2/2004 Waguespack ..... B41J 29/54 292/137
6,843,082 B2 * 1/2005 Vickers ..... E05B 17/04 292/64
6,874,198 B2 4/2005 Renaud
6,953,209 B2 * 10/2005 Jackson, Jr. ..... E05B 17/0025 16/412
7,452,011 B1 11/2008 Lind
7,770,420 B2 * 8/2010 Carr ..... E05C 19/003 292/259 R
8,469,410 B2 * 6/2013 Wood ..... E05C 7/00 292/288
8,585,102 B2 * 11/2013 Gottschling ..... E05B 17/0025 292/63

FOREIGN PATENT DOCUMENTS

FR 2971289 A1 * 8/2012
FR 3003594 A1 * 9/2014
GB 320772 A * 10/1929

* cited by examiner

SECURITY LATCH FOR DOOR HINGED TO OPEN OUTWARDLY

CROSS-REFERENCE TO RELATED APPLICATION

This is a perfection of U.S. Provisional Application Ser. No. 61/808,544, filed on Apr. 4, 2013, the disclosure of which is fully incorporated by reference herein.

BACKGROUND OF THE INVENTION

1. Technical Field

The present invention relates to safety/security latches for doors. More particularly, this invention relates to add-on latches for the outwardly hinged doors of most schools and numerous other industrial applications. The invention enables easy installation to a door interior without having to interfere with or modify the adjacent floor and/or frame to that door. One preferred manufacturing and marketing plan might make and sell these devices under the proposed product name: AUX LOC™.

2. Background Art

After the most recent school shooting disaster at Sandy Hook Elementary in Connecticut, many concepts were floated for trying to render individual school classrooms safe from an intruder. The goals were to provide supervising staff (i.e, teachers in the respective classrooms) with means for barricading them and their students in the safety of a secured room until help arrives to subdue the violent perpetrator. In many instances, it was understood that a full barricade too complex to deploy will not suffice. One that is simple to implement would be preferred as means for providing the teachers and students in a given setting with "some extra time" until the authorities appear on scene. Knowing how stress and panic levels sharply increase in such situations (despite numerous "practice drills"), it is critical that any such device be relatively simple to activate when needed.

Another main objective of providing additional security is to not make the respective classrooms appear too intimidating or "prison-like". It is one thing to keep the children safe and secure. It is another to traumatize the children by teaching them in "safety box" environs protected with multiple electronic locks, frame engaging rods and/or other gadgets. For instance, it would not be enough to just provide teachers and every classroom with a steel board or crossbar for their main access door(s), as most classroom doors hinge to open outwardly rather than inwardly into the room per typical industrial building codes.

Nor is it a viable "option" to provide safety/security means that easily implement by rapidly installing into floor apertures/brackets adjacent a closed door. Such obstructions create significant tripping hazards as well as difficult complications for custodial cleaning Ideally, devices are desired which are relatively easy to install . . . without having to physically alter, modify or rebuild every door frame/surround. Such devices could be mass-produced and rapidly retrofitted to most every door of a school or other industrial setting. Another main objective is to enable any such device with means for the authorities upon arrival to deactivate when "the situation" has been resolved (and the perpetrator(s) subdued).

The prior art contemplates numerous door-related devices none of which accomplish the goals and objectives of this invention. In chronological order, representative latch or latch-like devices include: the sliding door stop means of Silva U.S. Pat. No. 3,661,413; the concealed safety latch of Simms U.S. Pat. No. 4,094,541; the doorway security system of Sawchuk U.S. Pat. No. 4,705,309; the highly popular, well promoted floor-mounted doorstop of Winner Jr. et al. U.S. Pat. No. 5,490,304; the centrifugal force-activated door safety mechanism of Haq U.S. Pat. No. 6,550,186; the gravity activated door safety device of Renaud U.S. Pat. No. 6,874,198; and the swinging door safety latch apparatus of Lind U.S. Pat. No. 7,452,011.

SUMMARY OF THE INVENTION

The security latch apparatus of this invention has several features, no single one of which is solely responsible for its desirable attributes. It includes an easy-to-mount frame bracket from which extends a preset, desired distance rotatable latch arm. The bracket frame further includes a guide hole through which is drilled into and through the door an aperture for disengagement rod access. For less conspicuous applications, it is preferred to mount this assembly to a lower most corner of the door interior. The drilled access aperture on the exterior of every door will not draw attention to the average passersby.

On this same bracket, there is included a central pivot hinge. It allows the latch arm component to rotate from an open/stored position facing the hinge side of the door interior to an engaged or deployed position AFTER the door is fully closed within its current doorframe. The degree of rotation from "open" to "deployed" should not exceed 180 degrees, more preferably between about 110 to 145 degrees total.

The latch top profile is preferably angled or otherwise slightly curved at its bracket pivot outwardly from the door to which it attaches. The outermost end to this latch component is flattened for fitting closely over and then against the surrounding inner doorframe once the door is fully closed and the auxiliary lock engaged. Fully assembled and installed, it will prohibit someone outside the closed door from simply tugging on the handle (even if unlocked) to pull open that door and enter the room. For security reasons, it is best to position the latch of this invention close to the floor well out of arms reach should the door include a glass window that might be shot or otherwise broken during a conflict.

BRIEF DESCRIPTION OF THE DRAWINGS

The invention will be described in conjunction with the accompanying drawings of a representative latch device installed on a door hinged to open outwardly. In these drawings.

DESCRIPTION OF PREFERRED EMBODIMENTS

Figure 1:
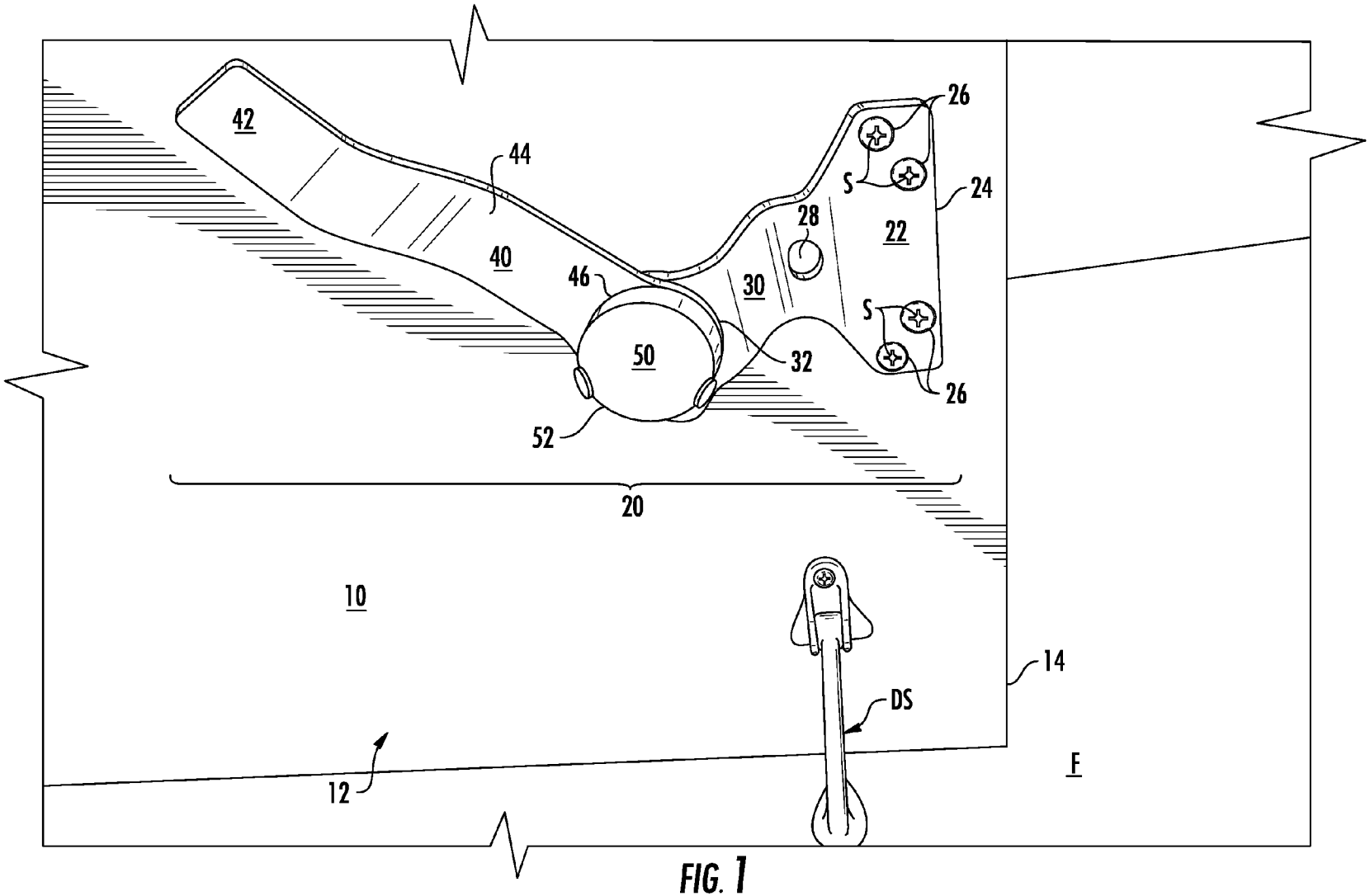
FIG. 1 is a front sectional view showing a first embodiment of latch apparatus installed in an "open" position on the bottom corner of a door propped open with a typical doorstop.
Figure 2:
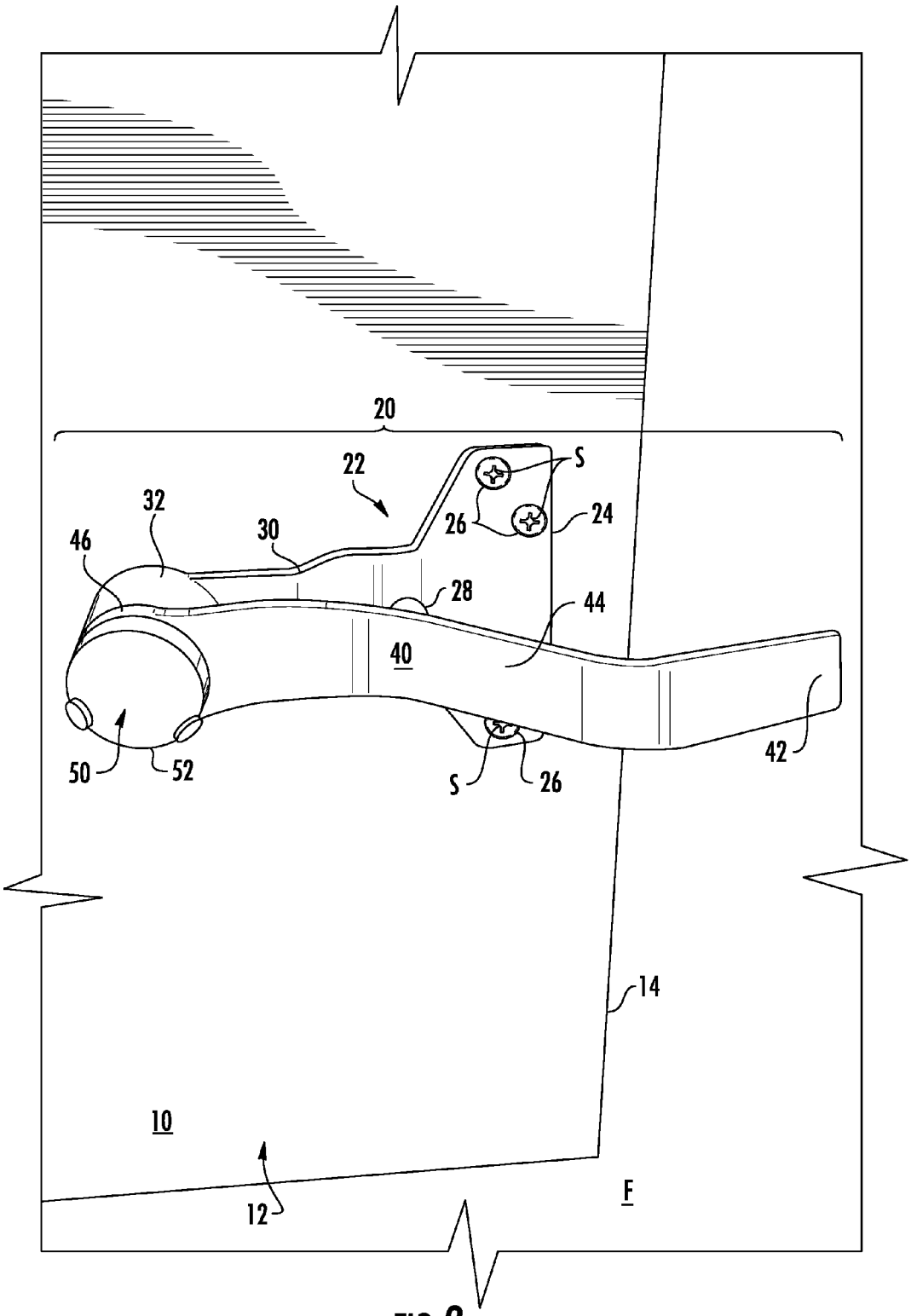
FIG. 2 is a front sectional view of FIG. 1 latch apparatus but with its pivot security handle rotated to its engaged position at the door bottom.
Figure 3:
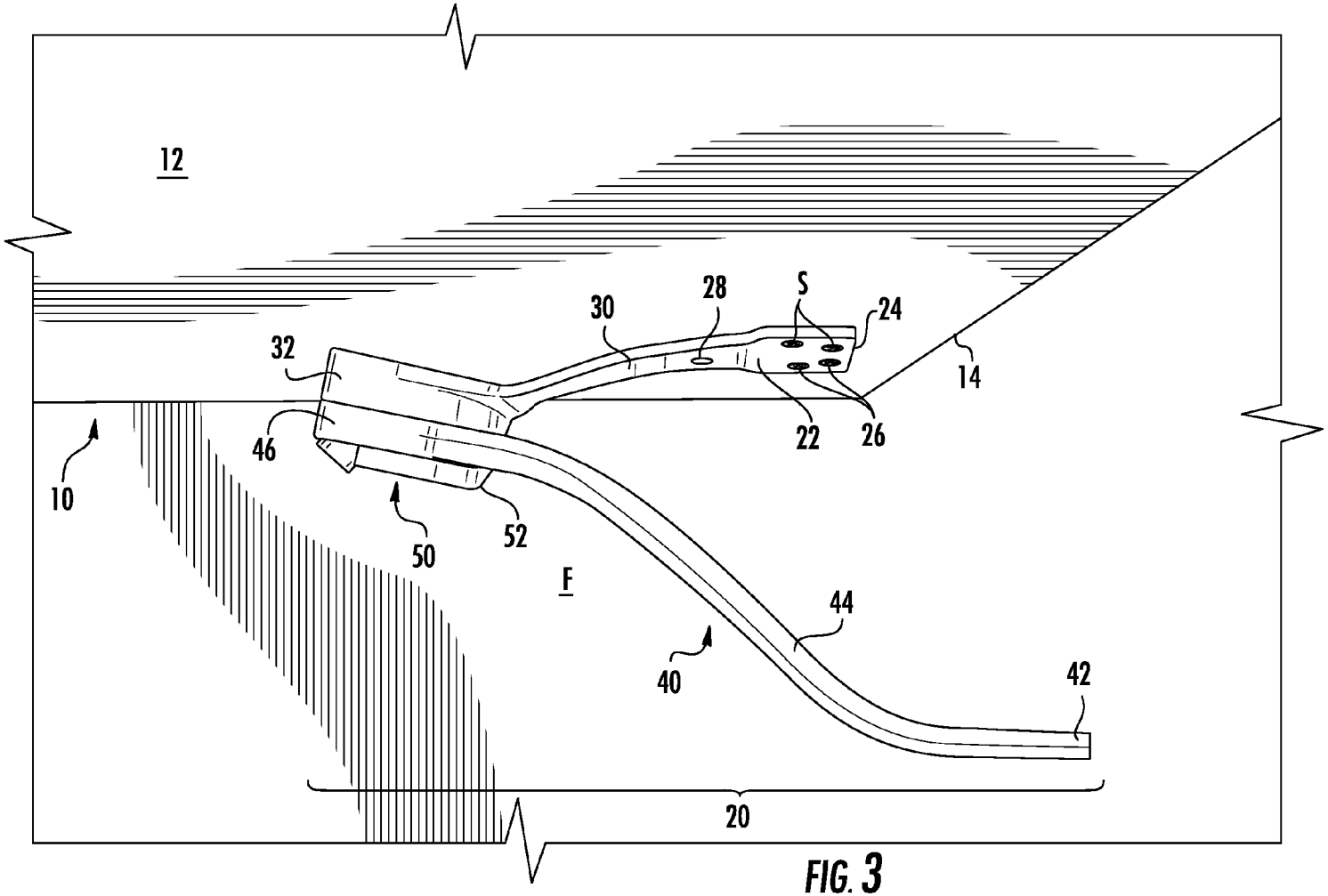
FIG. 3 is a top sectional view of the open/engaged latch apparatus from FIG. 2.
Figure 4:
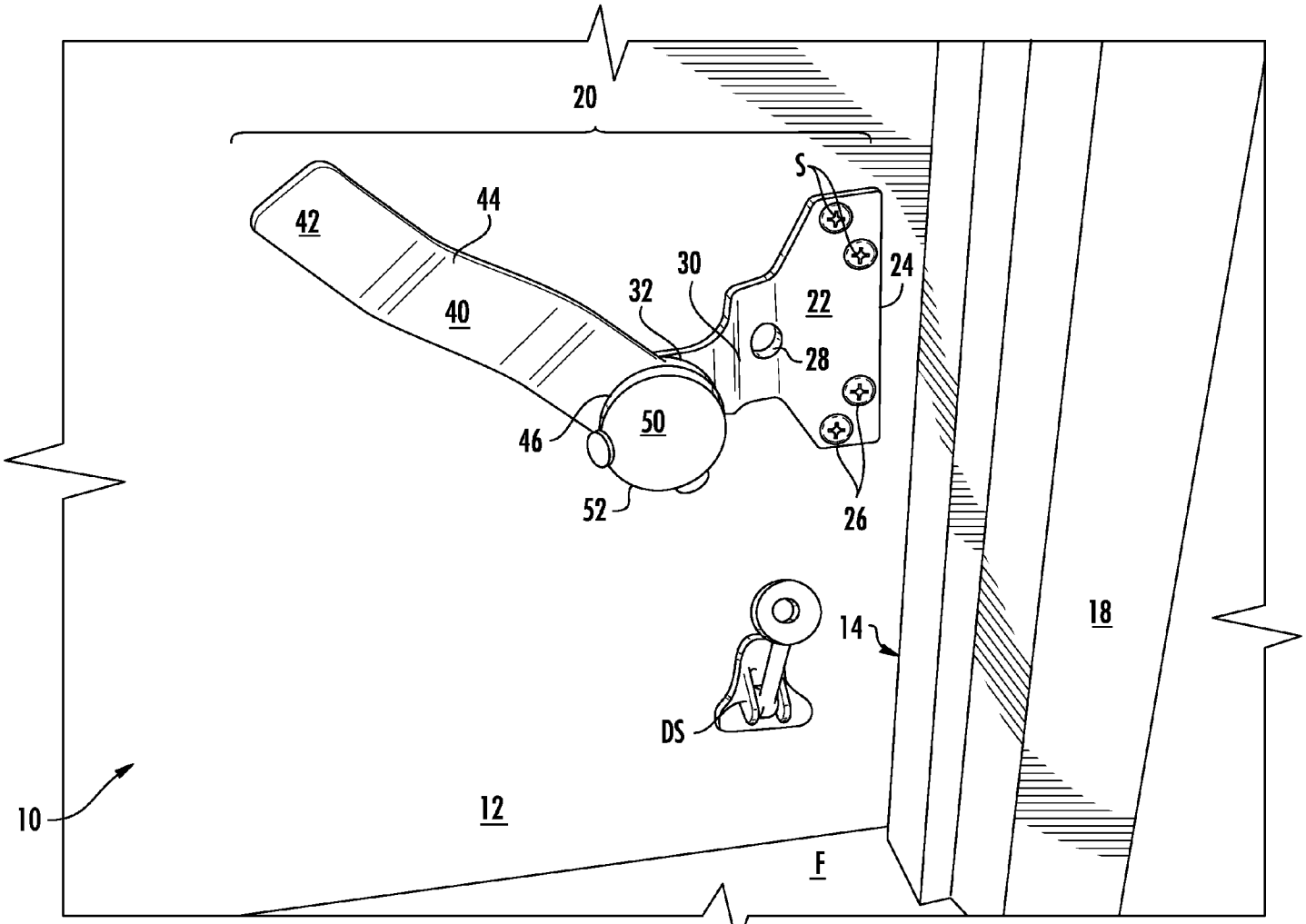
FIG. 4 is a front sectional view of the first latch apparatus on a fully closed door (with doorstop raised) before engaging with the adjacent doorframe.
Figure 5:
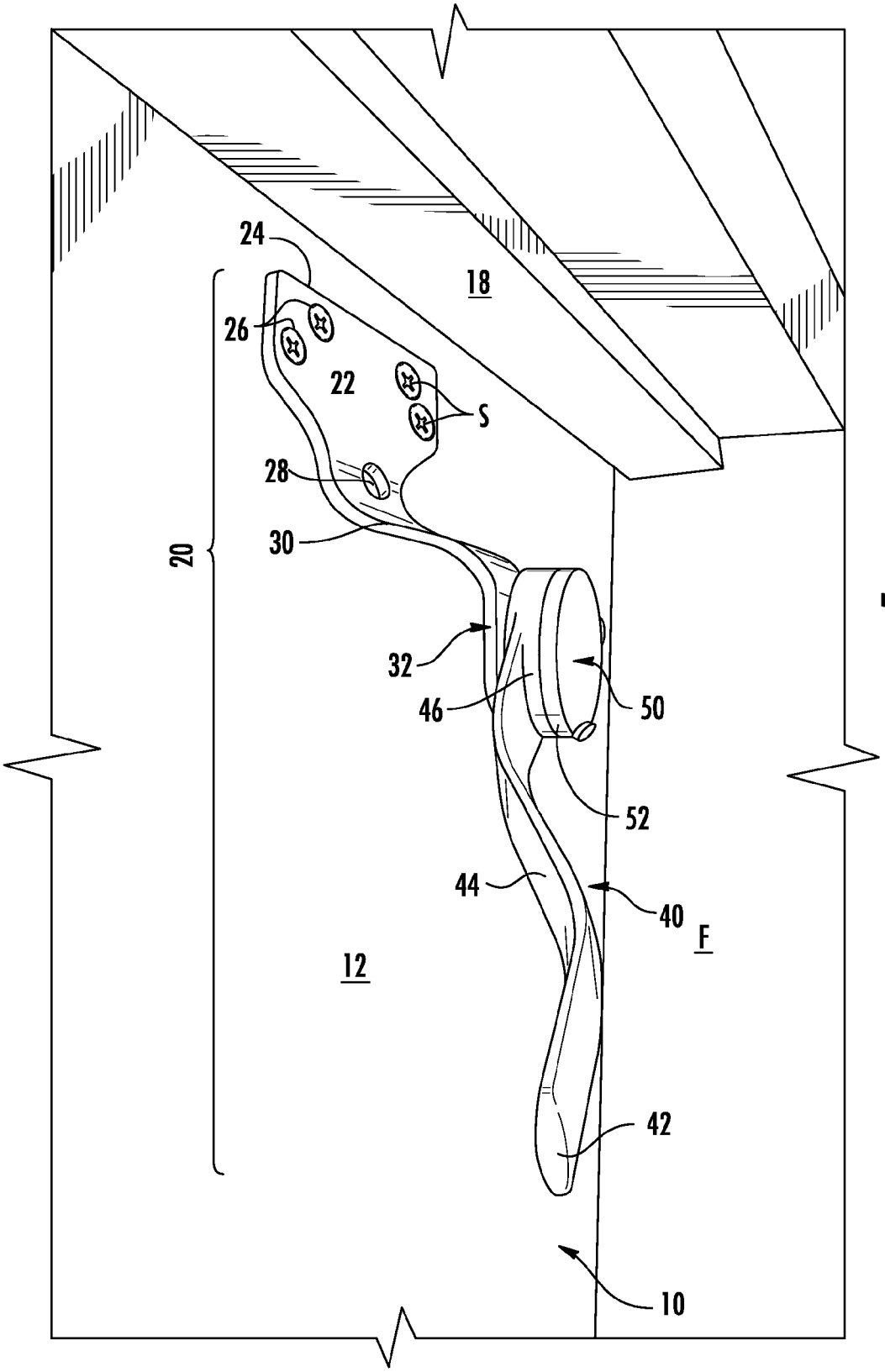
FIG. 5 is a top sectional view of the latch apparatus from FIG. 4 with doorstop removed for illustration purposes.
Figure 6:
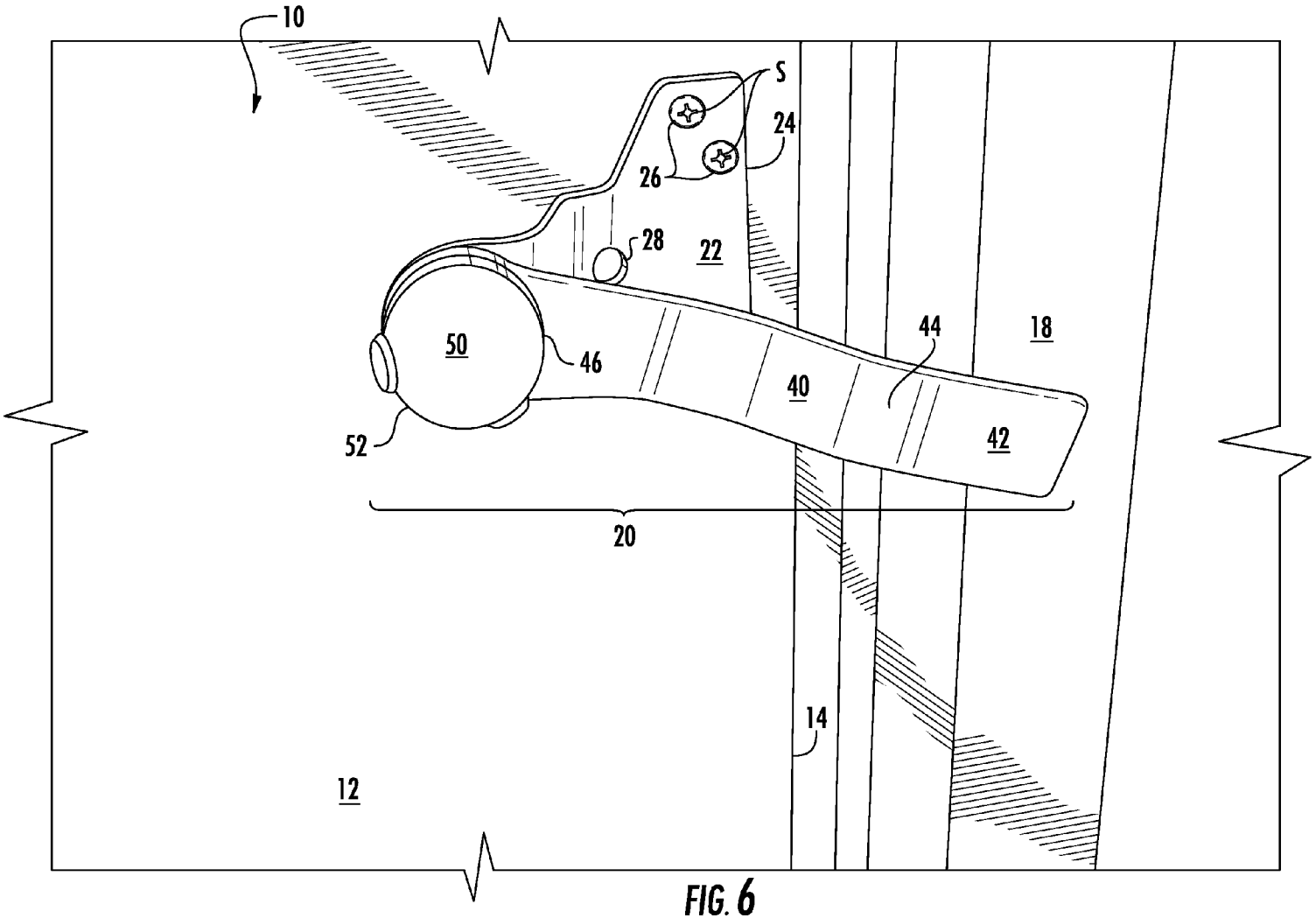
FIG. 6 is a front sectional view of the first latch apparatus with its pivot security handle rotated for engaging with the adjacent frame surround to a fully closed door.
Figure 7:
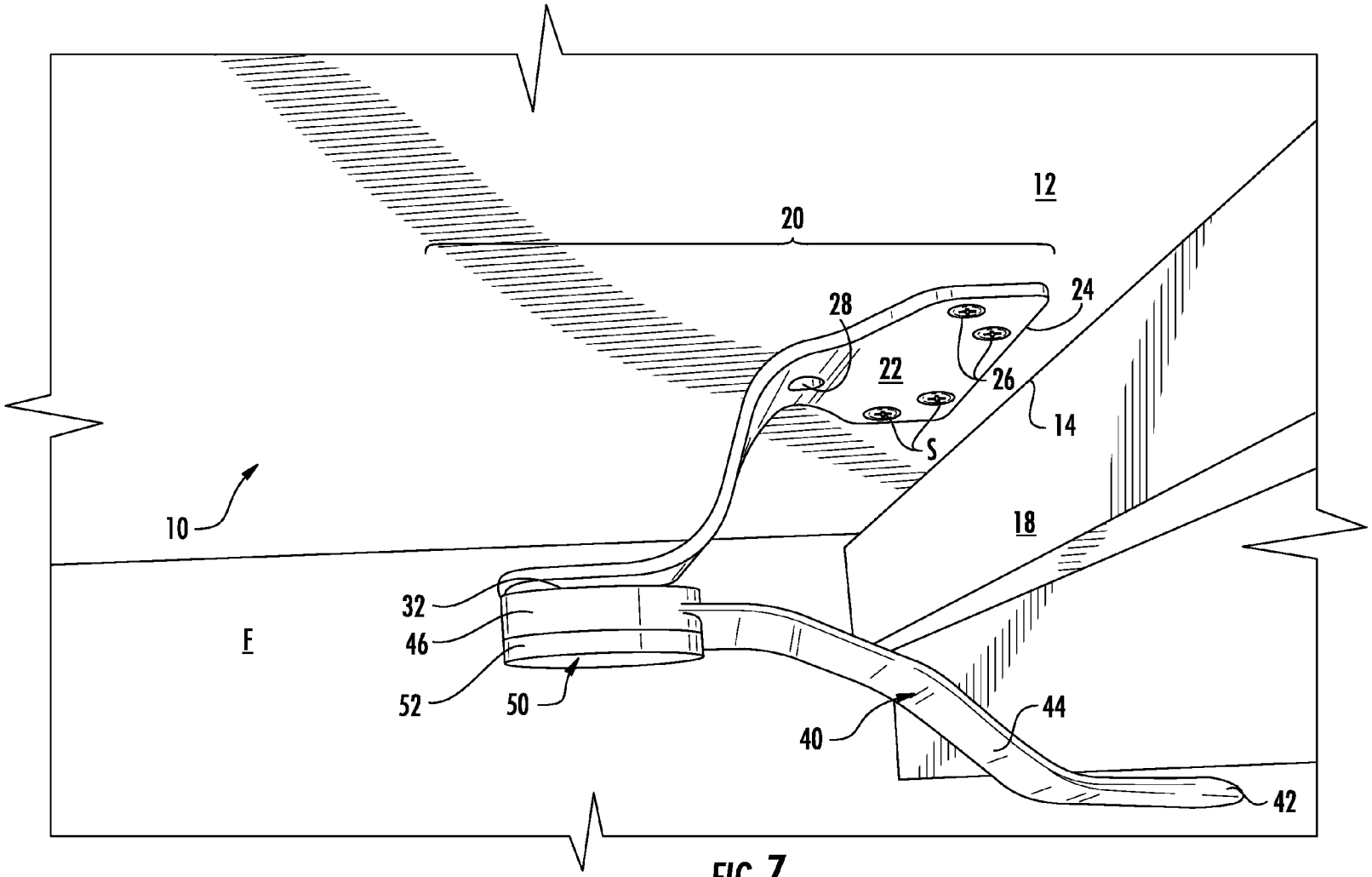
FIG. 7 is a top sectional view of the engaged latch apparatus from FIG. 6.
Figure 8:
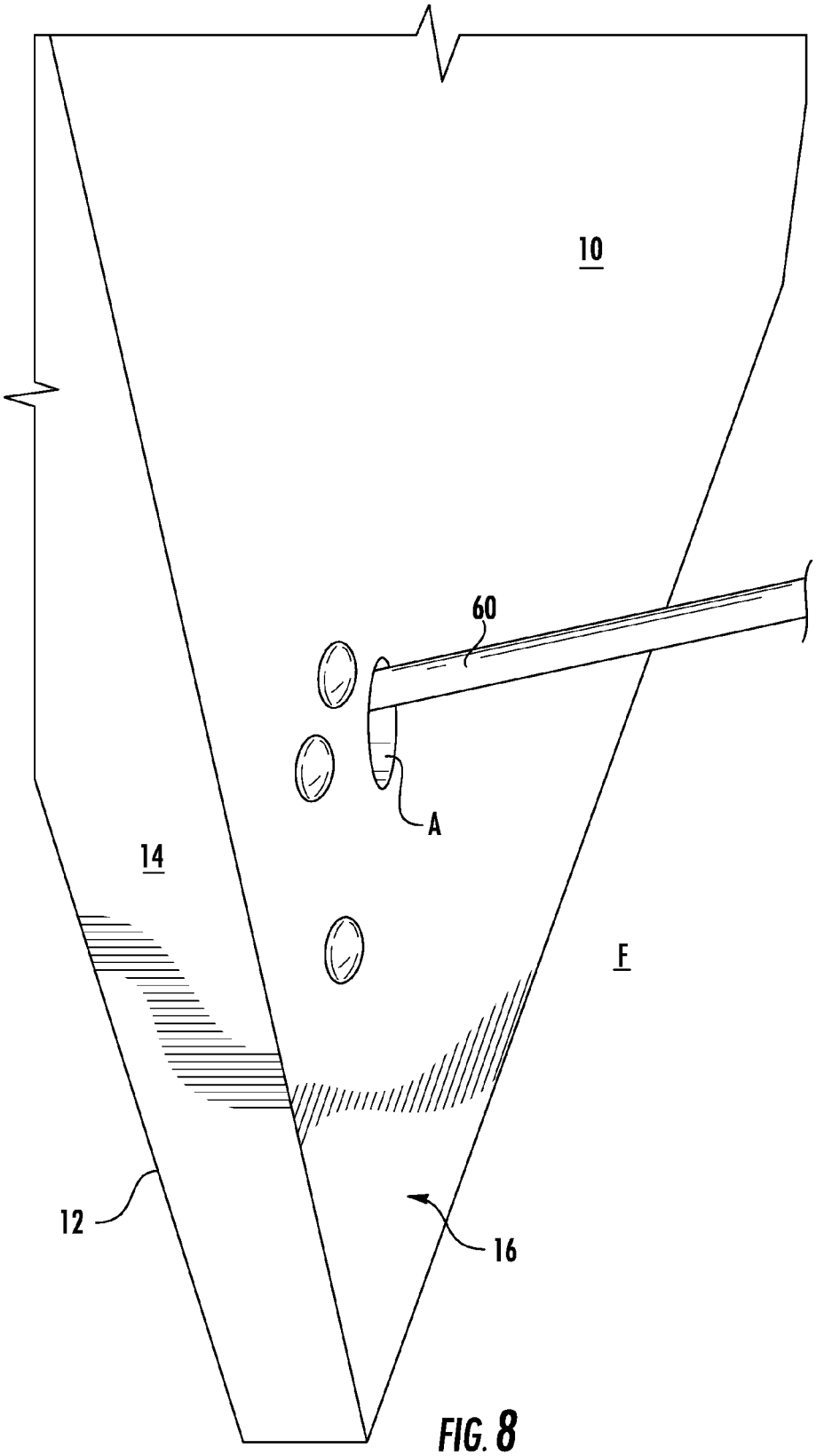
FIG. 8 is a side sectional view of a lower door exterior with an aperture through which a disengagement rod for this invention can be extended.
Figure 9:
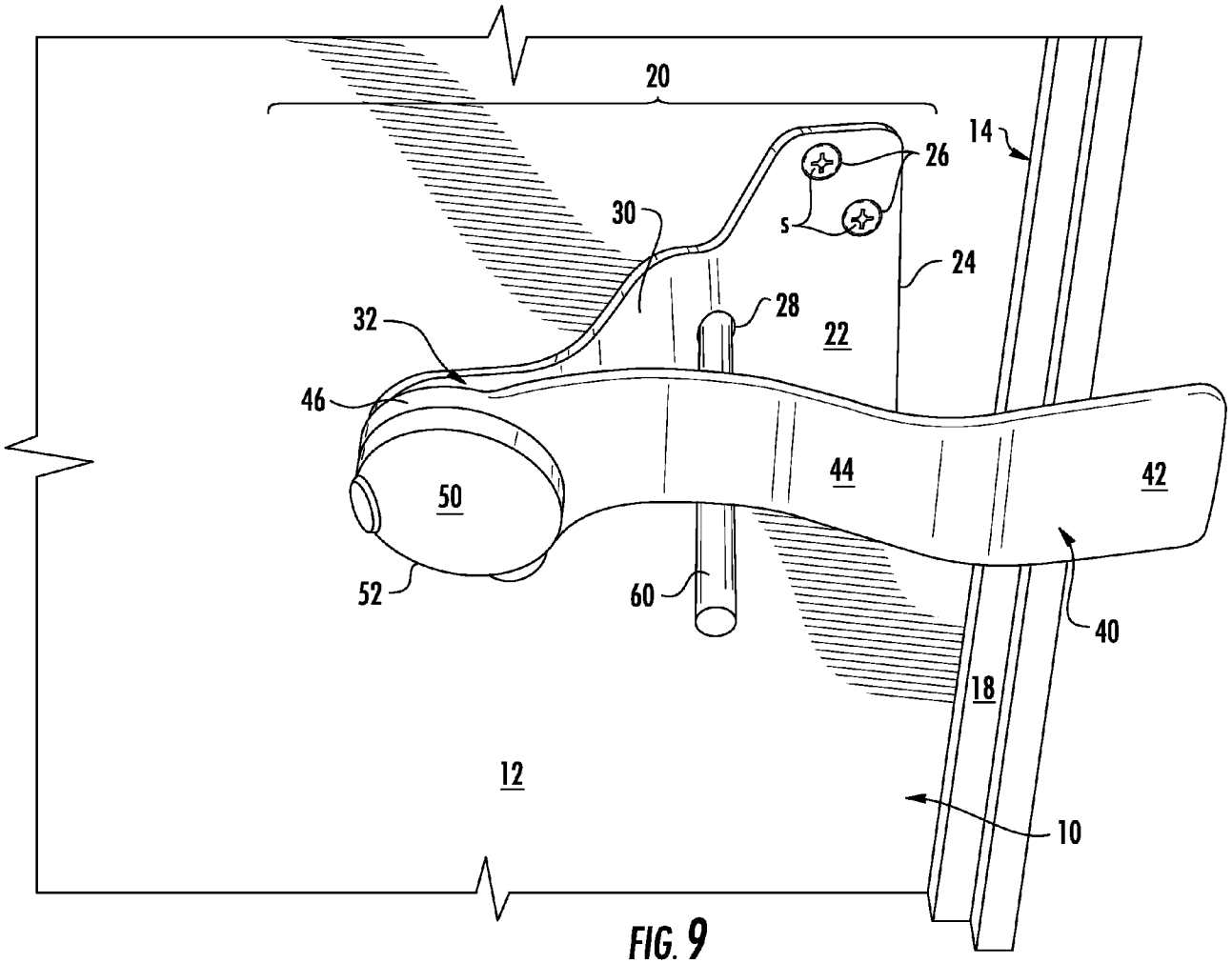
FIG. 9 is a front sectional view of an engaged latch apparatus with a disengagement rod extending through its bracket guide hole.
Figure 10:
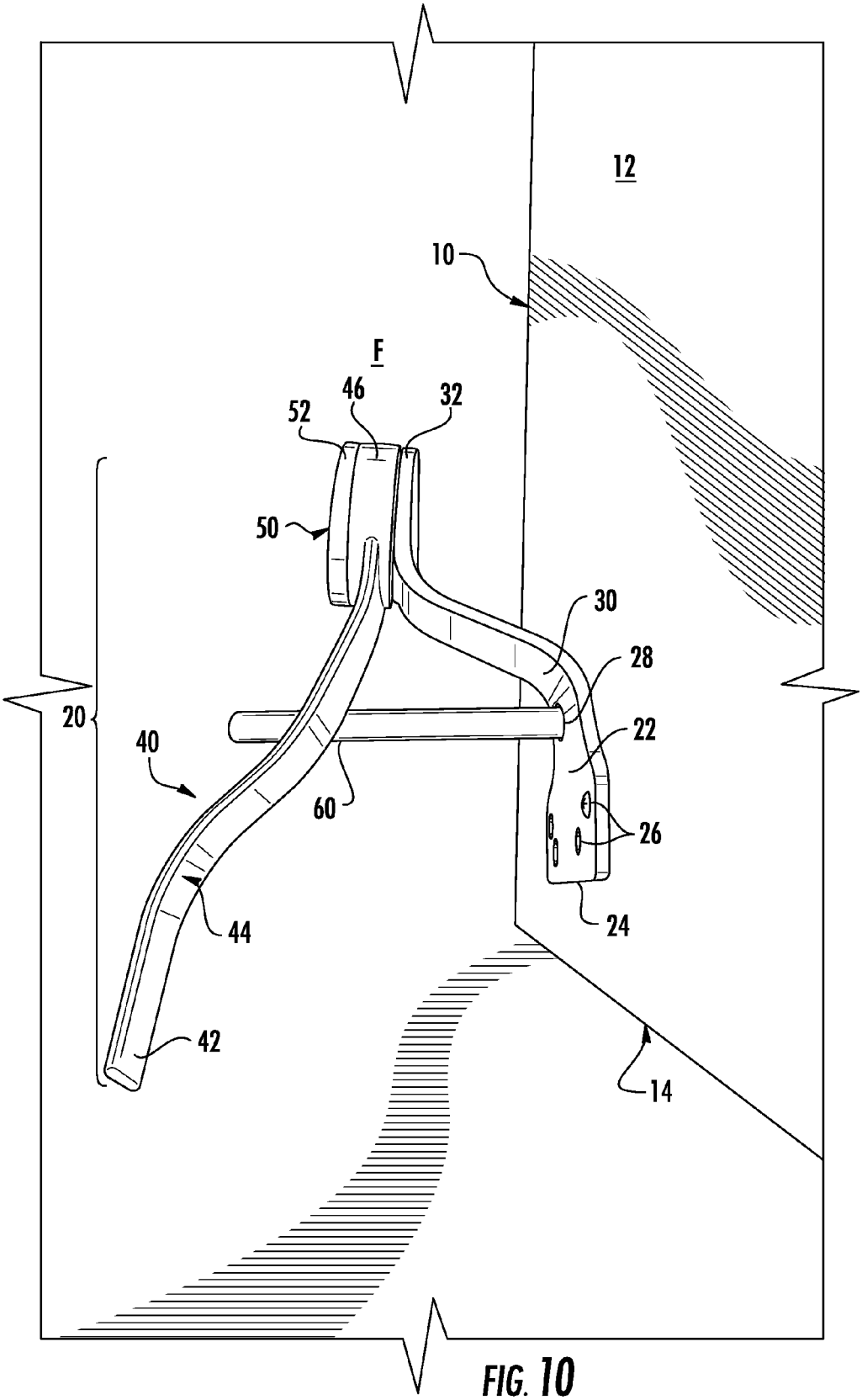
FIG. 10 is a top sectional view of the latch apparatus and disengagement rod from FIG. 9.
Figure 11:
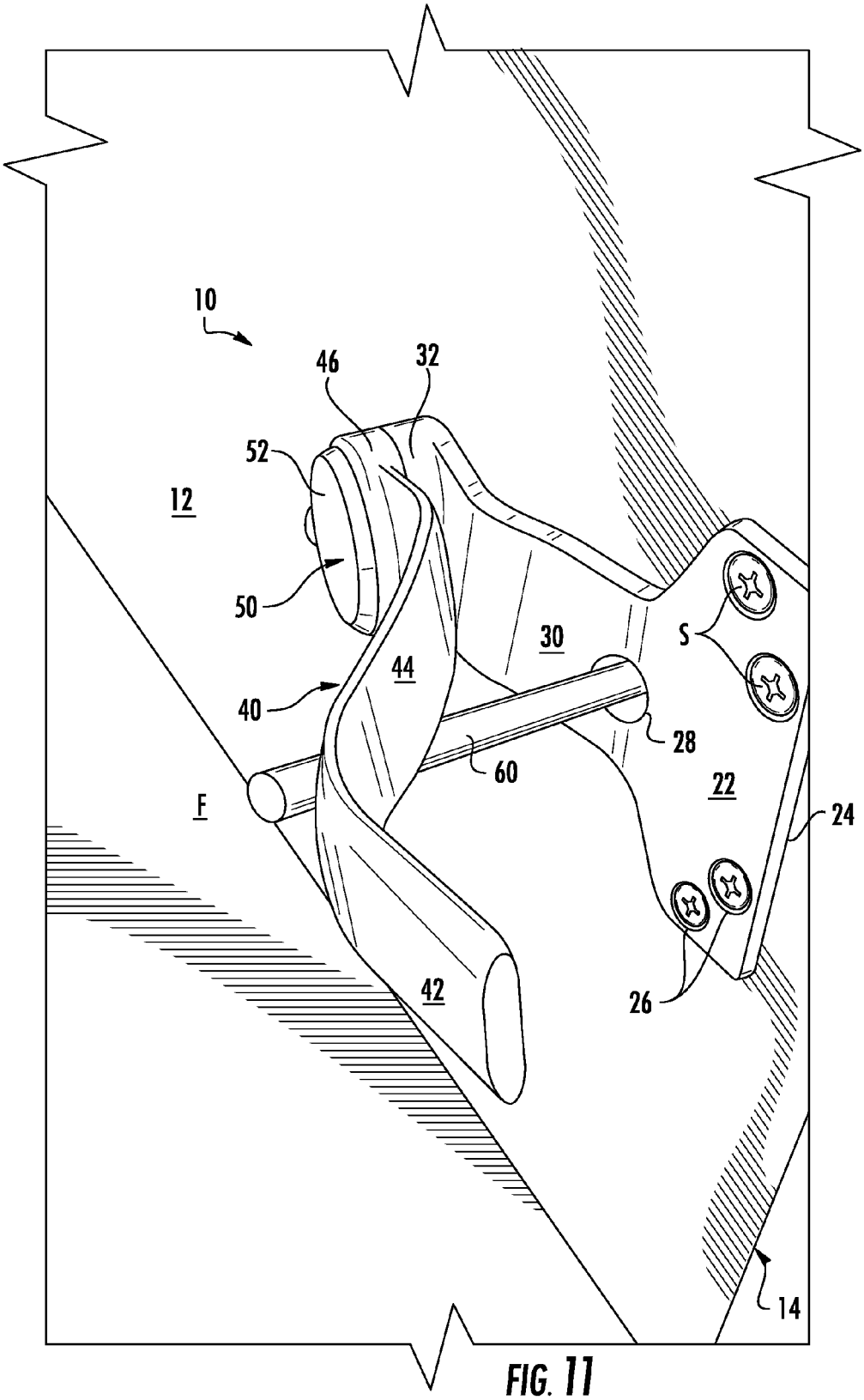
FIG. 11 is a side sectional view of the latch apparatus in the midst of being disengaged though on an open door (i.e. not latched to adjacent frame) for illustration purposes.
Figure 12:
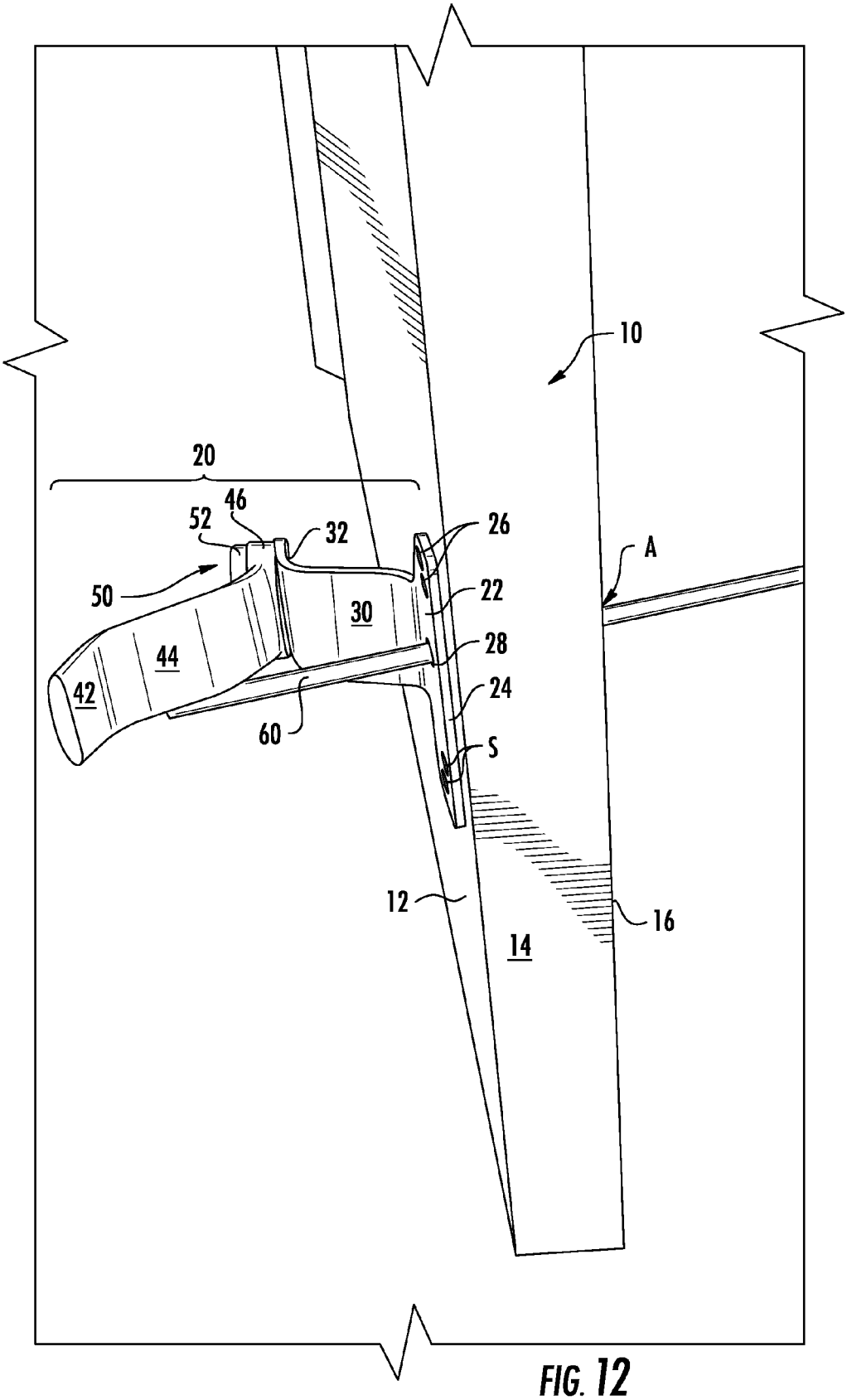
FIG. 12 is a side sectional view of the latch apparatus and rod of FIG. 11 as seen through the outer edge of that open door.
Figure 13:
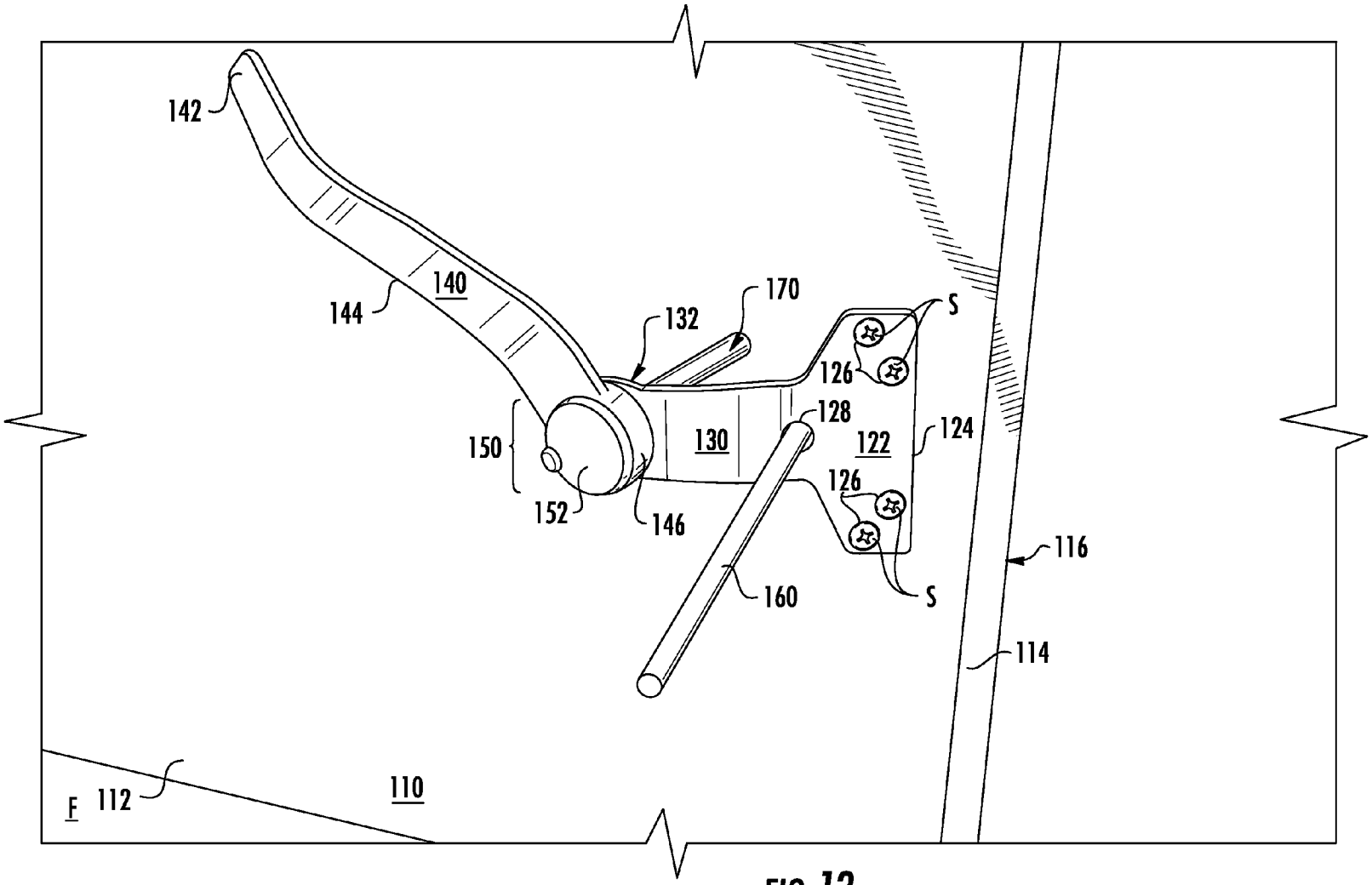
FIG. 13 is a front perspective sectional view of a second embodiment of latch apparatus in the midst of being rod disengaged.

The several embodiments discussed all relate to an add-on door safety/security latch apparatus. In FIGS. 1-12, a first latch embodiment is sectionally depicted in various open and engaged views. One alternate version is shown in accompanying FIG. 13. For that alternative, common components are consistently numbered though in the next hundred series. Yet other variations (not shown) may include an inwardly hooked end to the outermost latch arm edge. That hook end may provide greater security by extending over the outer edge of a typical industrial doorframe. It is less preferred, though, as it could prove harder to intentionally disengage due to that inwardly protruding hook end.

To the extent that an electronic warning system may be added, preferably wirelessly, to the frame proper of each unit, there is a further possibility of sending an alarm to the teacher in charge of a given classroom in the case of emergency. In addition, the wireless communication can be two-way such that the actual engagement of a device/unit could be used to signal back to the principal's office and/or to local authorities. Such alarms could be visual, audio or both.

Now referring to FIGS. 1 through 12, there is shown a typical industrial door 10 with its door interior 12, outermost door edge 14 and door exterior 16, said door 10 being inwardly hinged (not shown) to a lipped doorframe 18 for opening and closing a room entrance/exit point (or portal) over a floor F. The lower exterior of door 10 also includes a purposefully drilled hole or aperture A. It serves as the point through which a disengagement rod (described later) can be inserted for manually undoing the latch of this invention, from outside the closed/secured door in the event that nobody inside the classroom is able to undo same. Drilled hole or aperture A also aligns with aperture 28 in main latch apparatus 20. In several views, a typical foot-activated, hinge doorstop DS can be seen either flipped down and engaged with the floor F, or in an unused, flipped up state against the door interior 12.

As for the main latch apparatus 20, it comprises an easy-to-mount, main frame bracket 22 with a door mounting end 24 having a plurality of apertures 26 through which main mounting screws S extend. In the accompanying drawings, there are four (4) main mounting screws S, a left side pair and right side pair. Alternately, they may be perceived as an outer pair closest to the front edge of bracket 22 and an inner pair closer to the respective side edges of bracket 22. It is to be understood, however, that bracket 22 may be secured with fewer connectors, more than four screws and/or using other permanent connecting means like bolts with or without security heads (i.e., those requiring special ratcheting shapes and/or patterns).

Inward, and slightly upward, from door mounting end 24 of bracket 22, there is a centrally located aperture 28 through which the disengagement rod will extend. Still further inward, on a raised curve section 30 upwardly from aperture 28, there is positioned a circular-shaped base 32. Directly above base 32, there is a bent handled lever 40 with an outermost flat end 42, intermediate elbow component 44 and base connector end 46. Internal to the assembled pivot region 50 of latch apparatus 20, a button-like, rotating cap 52 includes a post (not shown) that passes through base connector end 46 and circular base 32 before being axially connected at its opposite end with a nut, locking washer and/or other standard rotatable connector (also not shown). Ideally, pivot region 50 enables the latch arm component, lever 40, to rotate from an open/disengaged position facing the hinged side of door interior 12 to a deployed position, at least partially overlapping/hanging a nearby (adjacent) edge to frame 18 AFTER the door has been fully closed regardless of whether the lock to that door can or has been secured. The full degree of rotation from "open" to "deployed" should not exceed 180 degrees, preferably less than 160 degrees and more preferably about 110 to 145 degrees total.

Main bracket 22 includes a guide aperture 28 or hole, preferably centrally located on the body proper of bracket 22. That aperture/hole is meant to serve as a guide/point during initial installation of the invention to the bottom interior of a school or industrial door. Particularly, an installer can use aperture 28 to mark where to drill into and completely through the whole width/thickness of door 10 so that a disengagement rod, element 60 in FIGS. 8 through 12, can be inserted therein from outside a closed, secured door for manually releasing this security latch in an emergency. Preferably, disengagement rods would be secured nearby and/or provided to emergency personnel (police, fire, SWAT teams) as well as to school/industrial building administrators. Most preferably, EACH classroom should have quick access to its own nearby disengagement rod for undoing a door that may have been accidentally triggered to engaged by a student, or by someone not authorized to keep others in the classroom. Should the need to rapidly "fish" the rod into the predrilled hole at the outside bottom of the door, the proper authorities can go to any nearby room for using their disengagement rod to free individuals otherwise being detained against their will in an interior-locked room.

For less conspicuous application, it is preferred to mount the entire latch apparatus assembly 20 to a lower most corner of each door interior 12. The drilled through access aperture A on that door's exterior 16 would not draw attention to the average passersby.

The entire unit is made from metal, preferably aluminum or steel alloy as most practical and cost effective. It can be kept as a metal surface, coated with a lacquer or zinc-coated for corrosion resistance. Alternately, if there are consistencies in door colors for a given school building, the units can be painted to better blend into (or possibly even compliment) the major color of most doors and doorframes. In a preferred version, the painting scheme selected should be used to better camouflage the bracket assembly to the door bottom. It is preferred that the selection of bracket coloring be kept less conspicuous so as to NOT serve as an attractive nuisance, potential play toy for the students being taught in that room. Because of its location OFF the floor and nearer the lower door edge, there is less concern for the assembly/apparatus posing any sort of tripping risk to passersby.

While some standardization exists with school/industrial doorframe sizes, shape and operation, usually through building code consistency, there may need to provide some adaptability (or "play") in the manner in which the brackets of this invention properly mount a spaced distance from each doorframe for consistent, failsafe operation. Such adaptability can be accomplished by providing bracket installation kits with a spacer rod in a variety of sizes/thicknesses. Referring to the alternate embodiment depicted in FIG. 13, such a spacer rod 170 can be custom manufactured to the back of pivot region 150, or supplied as part of an installation kit (in various heights/thicknesses and shapes/sizes so as to best fit the entire assembly 120 against its door interior 112.

Figure 14:
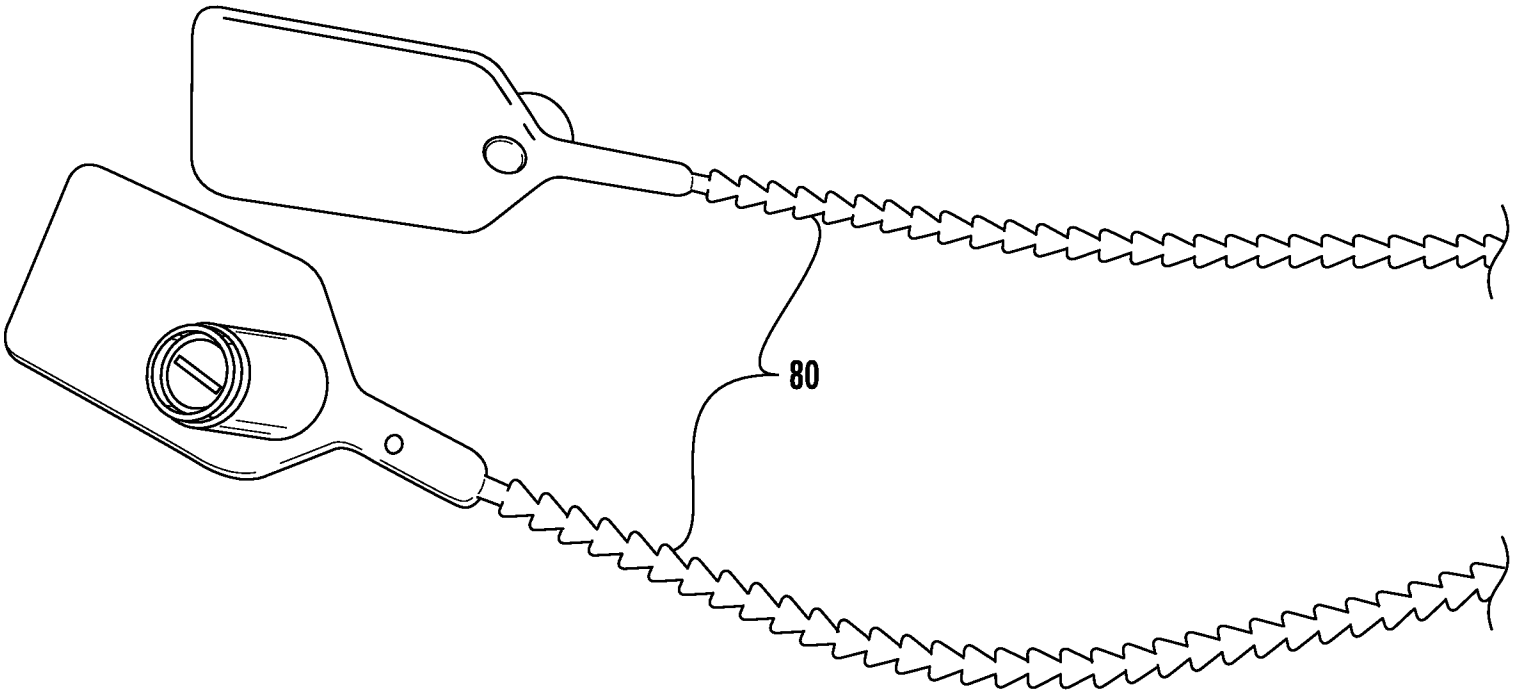
FIG. 14 is a top view of two representative plastic bands for easily breaking away but for safely holding the latch apparatus "open" until needed.

Still other alternatives may incorporate a low-tension spring or other mechanism for keeping the latch opened, i.e. not deployed or engaged, until necessary. That spring cannot be overly tensioned, however, as it may be necessary for an adult with less physical strength, or possibly even one who has been partially incapacitated in a struggle with an aggressor, to move a spring lever into position after the door is fully closed within its frame. Another way of accomplishing a way of keeping locks "open" until needed would be by banding them open with one of the two plastic breakaway strips 80 shown in accompanying FIG. 14 or with another similar "temporary banding means".

The outermost end to the latch component of this device is meant to flatten through the overall latch profile (especially in top view). It may be slightly curved from its bracket pivot connection outwardly to the tip of that latch. In any event, that outermost end should be configured (and duly sized) to readily engage with the frame surround of the door to which it is being mounted so that when installed and deployed on that door in its closed position, no one could merely tug on the door handle and pull that door open. There may be some size tolerance, of up to about ¼ inch, but not very much more. It is NOT meant for a door to be able to be pulled back and forth.

Also, for security reasons, it is best to position the latch of this invention quite close to the floor and out of arms reach should the door include a half glass window that might be shot out or otherwise broken during a conflict. It would serve little protection if an aggressor could reach through a broken glass component of the door and merely undo the above-described bracket protection by hand. Instead, if there is a need for authorities to undo an accidentally latched door either when there is no one inside the room or nobody with sufficient strength/dexterity to manually more the latch from "engaged" to an "open" position when it is safe to do so, there is provided a disengagement mechanism wherein a disengagement rod fed through a properly sized & positioned aperture in the door exterior can be used to manually rotate (or "flick") the latch up and adequately far enough away from the door frame surround.

The embodiments and examples set forth herein were presented to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the photographs or herein are given as an example of possible components and not as a limitation.

What is claimed is:

1. A security latch for a door hinged to open outwardly, said latch comprising:

a frame bracket for mounting to an interior of the door adjacent a surrounding frame of the door;

a pivot hinge connected to the frame bracket, said pivot hinge having a horizontal axis that extends perpendicular to a planar surface of the interior of the door, and said pivot hinge extending outwardly away from the interior of the door; and a latch arm that connects at one end to the pivot hinge and extends outwardly therefrom, said latch arm being adapted for rotating from a first point when the door is open, said first point being substantially over the door interior, to a second point when the door is closed and sitting within its surrounding frame, said second point requiring at least some physical overlap of an outermost end of the latch arm with the surrounding frame of the door, said frame bracket including an aperture through which a disengagement rod is positioned from outside the closed door to directly contact with and manually rotate the latch arm from the second point until the outermost end of said latch arm no longer physically overlaps the surrounding frame of the door.

2. The security latch of claim 1 wherein the door is an interior door of a school classroom.

3. The security latch of claim 1, which is painted a color close to that of the door.

4. The security latch of claim 1, which further includes a spacer that extends between the frame bracket and the door interior.

5. The security latch of claim 1, which further includes a spring or plastic banding for holding the latch arm open until needed.

6. The security latch of claim 1, which is made from a metal selected from aluminum and steel.

7. the security latch of claim 1, which further includes an alarm for alerting those in the room to close the door and engage the latch arm to the doorframe.

8. The security latch of claim 7 wherein said alarm also alerts building administration when the latch arm has been engaged or disengaged thereafter.

9. The security latch of claim 7 wherein the alarm is wireless and can include a visual notification, audio warning or both.

10. The security latch of claim 1 wherein said latch arm can be manually rotated by about 180 degrees or less.

11. The security latch of claim 10 wherein said latch arm can be manually rotated between about 110 to 145 degrees.

12. The security latch of claim 1 wherein the aperture is offset of the horizontal axis of the pivot hinge.

13. A security latch for keeping a closed door from being pulled open about its outwardly extending hinges, said latch apparatus comprising:

a frame bracket for mounting to the door interior adjacent the door's surrounding frame;

a pivot hinge having a horizontal axis that extends perpendicular to a planar surface of the door interior, said pivot hinge angularly extending outwardly from the door interior and away from the frame bracket; and a rotatable latch arm that extends from one side of the pivot hinge, said latch arm being adapted for rotating in place and fitting next to or partially engaging with the door's surrounding frame, said frame bracket having an aperture that serves as a guide hole through which a hole is drilled through the door to enable a disengagement rod to be fed from outside the door and through said hole to directly contact with and manually rotate the latch arm until the latch arm no longer engages with the door's surrounding frame.

14. The security latch of claim 13, which further includes a spacer rod that extends from behind the frame bracket to the door interior.

15. The security latch of claim 13, which allows for latch arm rotation about the pivot hinge, from an open position to a doorframe engaging position.

16. The security latch of claim 13 wherein said latch arm can be manually rotated by no more than 180 degrees.

17. The security latch of claim 16 wherein said latch arm can be manually rotated between about 110 to 145 degrees.

18. The security latch of claim 13 wherein said latch arm has a substantially flat outermost end for engaging with the door's surrounding frame.

19. The security latch of claim 13 wherein the pivot hinge includes a spring or plastic banding for holding the latch arm in an open position until needed.

20. The security latch of claim 13 wherein the aperture is offset of the horizontal axis of the pivot hinge.

* * * * *